US008690545B2

(12) United States Patent
Martin

(10) Patent No.: US 8,690,545 B2
(45) Date of Patent: Apr. 8, 2014

(54) RECIPROCATING PISTON COMPRESSOR

(75) Inventor: Eduardo Martin, Leipzig (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 161 days.

(21) Appl. No.: 12/831,508

(22) Filed: Jul. 7, 2010

(65) Prior Publication Data

US 2011/0005266 A1 Jan. 13, 2011

Related U.S. Application Data

(63) Continuation of application No. PCT/EP2008/068357, filed on Dec. 30, 2008.

(30) Foreign Application Priority Data

Jan. 10, 2008 (DE) ..... 10 2008 004 569

(51) Int. Cl.
*F04B 39/04* (2006.01)
*F04B 39/06* (2006.01)

(52) U.S. Cl.
USPC ..... 417/228; 417/87; 184/6.5

(58) Field of Classification Search
USPC ..... 417/228, 902, 85, 87, 415; 184/6.16, 184/6.18, 6.5, 6.6
See application file for complete search history.

(56) References Cited

U.S. PATENT DOCUMENTS 1,611,030 A 12/1926 Hele-Shaw et al.
1,795,445 A * 3/1931 Rolaff ..... 417/255
2,023,435 A * 12/1935 Peltier et al. ..... 62/221
2,054,097 A * 9/1936 Replogle ..... 417/338
2,128,065 A * 8/1938 Aikman ..... 184/6.5
2,150,487 A * 3/1939 Brown ..... 92/80
2,155,051 A * 4/1939 Kagi ..... 62/193
2,233,168 A * 2/1941 Johnson ..... 92/153
2,629,538 A * 2/1953 Replogle ..... 417/416
3,713,513 A 1/1973 Harris et al.
3,746,477 A * 7/1973 Ozu et al. ..... 417/372
3,912,044 A * 10/1975 Schindelhauer ..... 184/6.16

(Continued)

FOREIGN PATENT DOCUMENTS

DE 10 44 839 11/1958
DE 19 72 144 11/1967

(Continued)

*Primary Examiner* — Devon Kramer
*Assistant Examiner* — Amene Bayou
(74) *Attorney, Agent, or Firm* — Reinhart Boerner Van Deuren P.C.

(57) ABSTRACT

In order to improve a reciprocating piston compressor for a refrigerant circuit, comprising a crankcase, in which a collecting chamber for lubricant is arranged, a cylinder housing, in which at least one reciprocating piston is movable in an oscillating manner, a valve plate which closes the cylinder housing and in which at least one inlet valve and one outlet valve are arranged, and a cylinder head, in which a suction gas duct which runs to the inlet valve and a compressed gas duct which leads away from the outlet valve are provided, in such a manner that excessive accumulations of lubricant can be avoided, it is suggested that a lubricant suction conduit be provided which has an inlet opening associated with the collecting chamber and an outlet opening associated with the suction gas duct and that the outlet opening be located in an area of the suction gas duct, in which a static pressure, which is lower than a static pressure in the collecting chamber for lubricant, prevails at least temporarily.

19 Claims, 5 Drawing Sheets

(56) References Cited

U.S. PATENT DOCUMENTS

| | | | | | |
|---|---|---|---|---|---|
| 4,127,363 | A | * | 11/1978 | Kato et al. | 417/269 |
| 4,413,954 | A | | 11/1983 | Okazaki | |
| 4,613,284 | A | * | 9/1986 | Baumberg | 417/76 |
| 5,190,121 | A | * | 3/1993 | Muzyk | 184/6.5 |
| 5,431,025 | A | * | 7/1995 | Oltman et al. | 62/84 |
| 5,735,676 | A | * | 4/1998 | Loos | 417/407 |

FOREIGN PATENT DOCUMENTS

| | | |
|---|---|---|
| DE | 41 34 184 A1 | 4/1993 |
| DE | 43 20 541 | 12/1994 |
| GB | 1 244 105 | 8/1971 |
| GB | 1 412 776 | 11/1975 |
| WO | WO 95/00251 | 1/1995 |

* cited by examiner

RECIPROCATING PISTON COMPRESSOR

CROSS-REFERENCE TO RELATED PATENT APPLICATIONS

This application is a continuation of international application number PCT/EP2008/068357 filed on Dec. 30, 2008.

The present disclosure relates to the subject matter disclosed in international application number PCT/EP2008/068357 of Dec. 30, 2008 and German application number 10 2008 004 569.1 of Jan. 10, 2008, which are incorporated herein by reference in their entirety and for all purposes.

BACKGROUND OF THE INVENTION

The invention relates to a reciprocating piston compressor for a refrigerant circuit, comprising a crankcase, in which a collecting chamber for lubricant is arranged, a cylinder housing, in which at least one reciprocating piston is movable in an oscillating manner, a valve plate which closes the cylinder housing and in which at least one inlet valve and one outlet valve are arranged, and a cylinder head, in which a suction gas duct running to the inlet valve and a compressed gas duct leading away from the outlet valve are provided.

The problem with reciprocating piston compressors of this type, particularly when they are built into a refrigerant circuit as reciprocating piston compressor for one of several compressor stages, is that the amount of lubricant collected in the crankcase is larger than provided for, depending on the operating conditions.

The result of this is that either the amount of lubricant required altogether is greater than provided for or other components of the refrigerant circuit, for example a compressor arranged on the outlet side, do not have enough lubricant available.

The object underlying the invention is, therefore, to improve a reciprocating piston compressor of the generic type in such a manner that excessive accumulations of lubricant can be avoided.

SUMMARY OF THE INVENTION

This object is accomplished in accordance with the invention, in a reciprocating piston compressor of the type described at the outset, in that a lubricant suction conduit is provided which has an inlet opening associated with the collecting chamber and an outlet opening associated with the suction gas duct and that the outlet opening is located in an area of the suction gas duct, in which a static pressure, which is lower than a static pressure in the collecting chamber for lubricant, prevails at least temporarily.

The advantage of the solution according to the invention is to be seen in the fact that it is possible, as a result of such a configuration, to draw lubricant out of the collecting chamber by suction and supply it to the suction gas which then conveys this lubricant through the reciprocating piston compressor and conveys it further in the refrigerant circuit via the compressed gas duct to, for example, the next compressor in the refrigerant circuit.

As a result, it is possible, in a simple and inexpensive manner, to avoid an excessively large amount of lubricant collecting in the reciprocating piston compressor and, therefore, the problems which have already been explained occurring as a result.

With respect to the inlet opening in the collecting chamber, no further details have so far been given.

In principle, the possibility would exist of arranging the inlet opening close to a base of the collecting chamber so that it would be possible, as a result, to draw lubricant out of the collecting chamber by suction when the static pressure in the area of the suction gas duct is lower than the static pressure in the collecting chamber.

It is, however, even more advantageous when the inlet opening is arranged in the collecting chamber such that it predetermines a specific position of a surface level of a lubricant bath.

Therefore, it can already been ensured as a result of arrangement of the position of the inlet opening that too much lubricant will not be drawn out of the collecting chamber by suction but rather that an amount of lubricant which is sufficient for the respective reciprocating piston compressor will always remain in the collecting chamber.

This is of advantage, in particular, when the surface level of the lubricant bath falls below the inlet opening since no lubricant will be drawn off by suction in the case where the static pressure in the area of the suction gas duct is lower than the static pressure in the crankcase but only the lubricant present in any case in the crankcase will be drawn off by suction.

In this respect, it is particularly favorable when the inlet opening of the lubricant suction conduit predetermines a lowest surface level of the lubricant bath which can be achieved by drawing off lubricant by suction via the lubricant suction conduit.

With respect to the course of the lubricant suction conduit in the crankcase, no further details have so far been given.

One advantageous solution, for example, provides for the lubricant suction conduit to extend at least in sections through a pipe projecting into the crankcase.

This pipe preferably has the inlet opening and so the position of the inlet opening can also be defined by positioning the pipe in the crankcase.

Another advantageous solution provides for the lubricant suction conduit to extend in the crankcase at least in sections, i.e., be integrally formed in a wall of the crankcase and, therefore, for no additional pipe to be required at least for this section.

Furthermore, the position of the inlet opening of the lubricant suction conduit may likewise be fixed in a simple manner with this solution and, therefore, the minimum level of lubricant which can be achieved as a result of drawing off by suction can, for example, be determined.

In order to lower the static pressure in the area of the suction gas duct, in which the outlet opening is located, it is preferably provided for the area having the outlet opening of the lubricant suction conduit to be located in a narrow region of a nozzle.

As a result, a static pressure will be generated in the narrow region in the case of suction gas flowing through the nozzle and this pressure will be lower than the normal pressure in the suction gas and, therefore, a pressure gradient can be achieved between the static pressure in the crankcase, in particular in the collecting chamber, and the static pressure in the narrow region of the nozzle, as a result of which the lubricant will be drawn out of the collecting chamber by suction.

An alternative solution provides for the area of the suction gas duct having the outlet opening of the lubricant suction conduit to be located behind a throttling device in the suction gas duct in flow direction of the stream of suction gas.

Such a throttling device allows, for example, the static pressure to be reduced behind the throttling point, at least temporarily, to such an extent that a pressure gradient occurs between the collecting chamber in the crankcase and the area of the outlet opening in the suction gas duct and, therefore, lubricant will be drawn out of the collecting chamber by suction.

In this respect, the throttling device could be realized, for example, as a constantly active throttling point by way of, for example, a very inexpensive screen which does, however, display a constant throttling action.

Another advantageous solution provides for an adjustable throttling device to be provided which offers the possibility, for example, of adjusting the throttling action and, therefore, also the static pressure in the area between the throttling point and the inlet valve, depending on the size of the stream of suction gas.

In this respect, the adjustable throttling device can be adjustable statically, i.e. have a constant setting over a plurality of operating cycles.

Another solution which impairs the compressor capacity as little as possible provides for the adjustable throttling device to alternate between time intervals which are essentially free of throttling and time intervals with active throttling.

In this respect, the time intervals with active throttling can extend over less than one operating cycle of the reciprocating piston compressor or over several operating cycles.

The intervals free of throttling preferably extend over several operating cycles in order to impair the compressor capacity as little as possible.

Additional features and advantages of the invention are the subject matter of the following description as well as the drawings illustrating several embodiments.

DETAILED DESCRIPTION OF THE INVENTION

Figure 1:
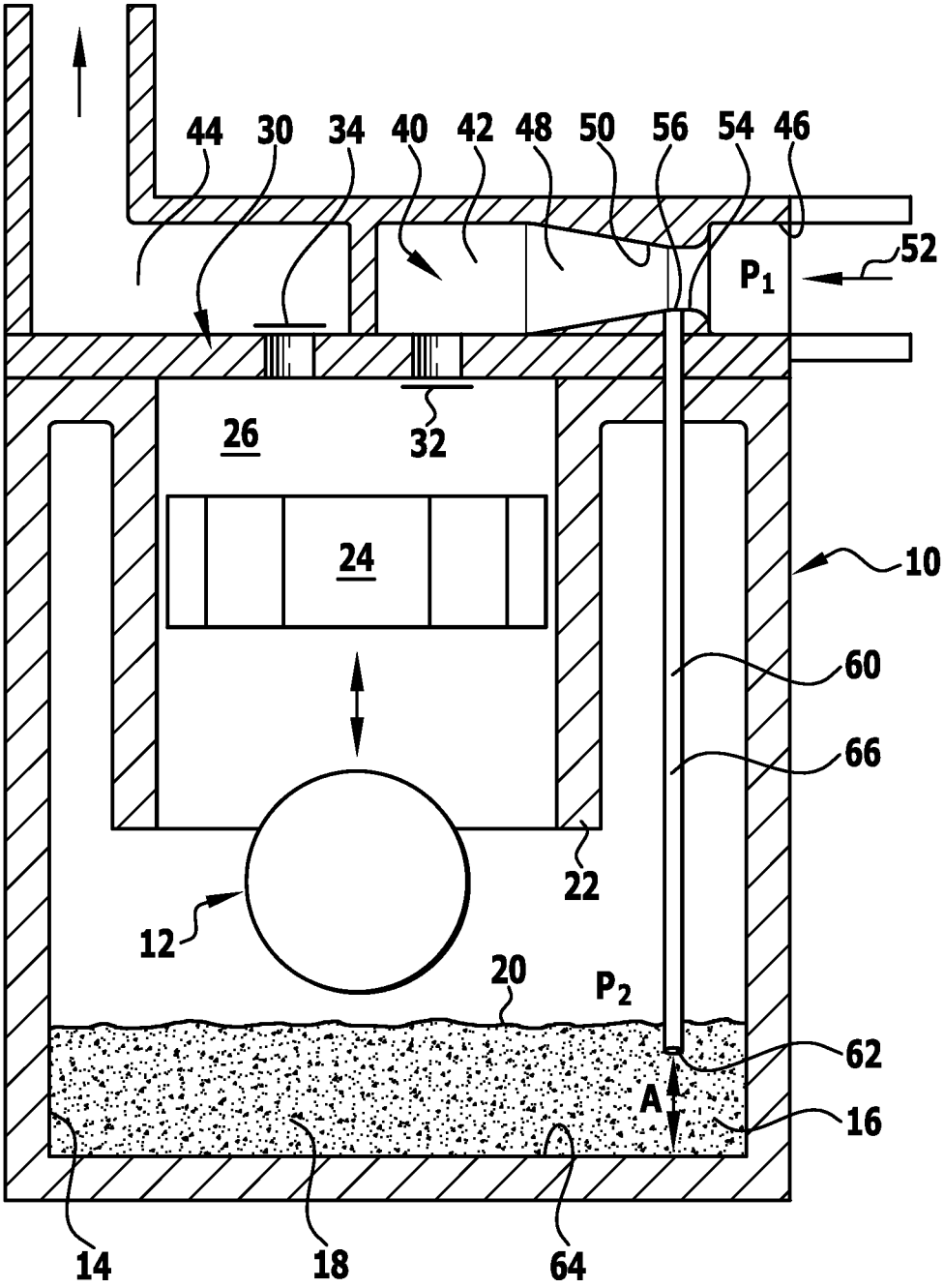
FIG. 1 shows a schematic sectional view through a first embodiment with an excessively large amount of lubricant in a collecting chamber of the crankcase.
Figure 2:
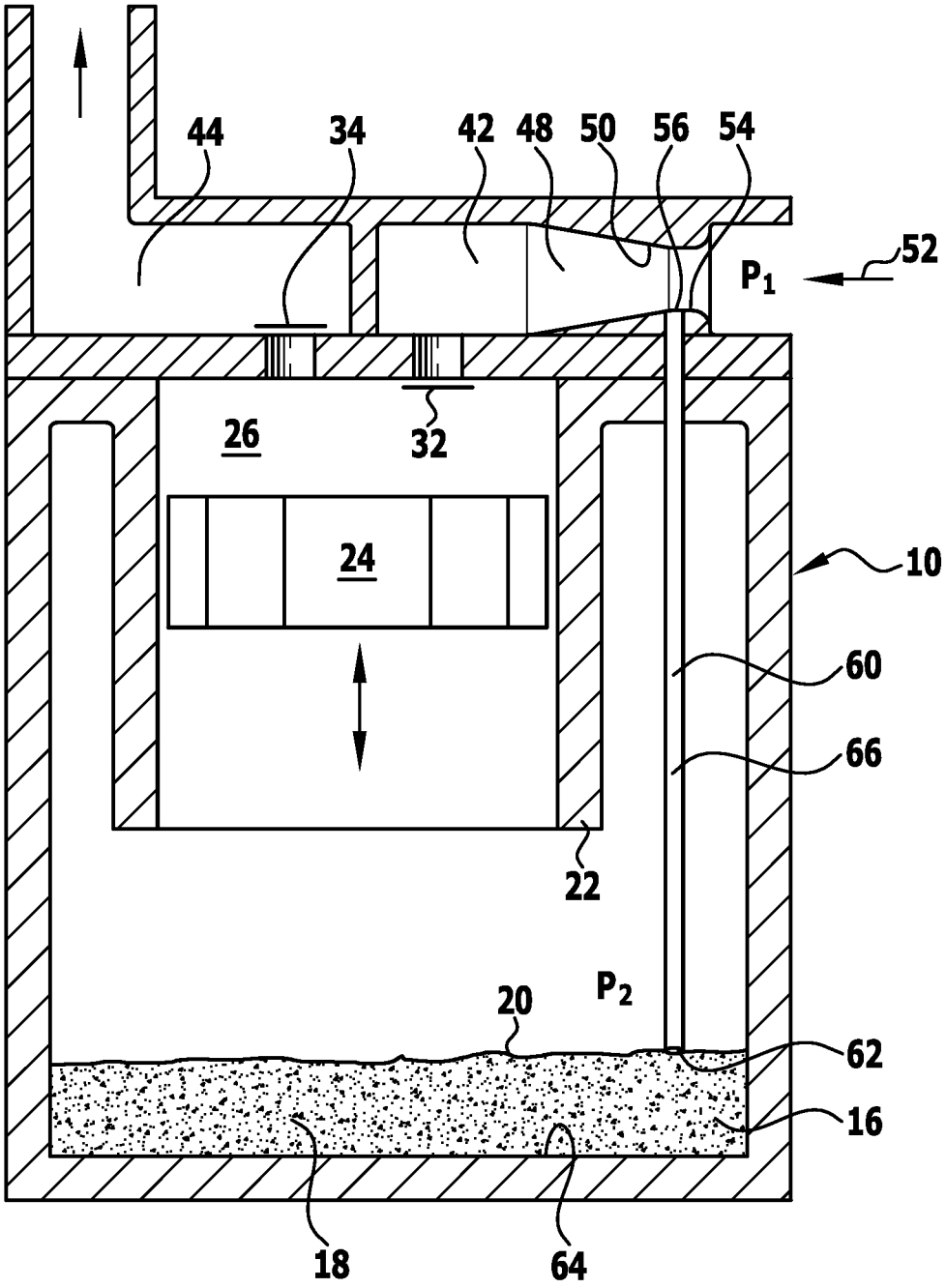
FIG. 2 shows a section similar to FIG. 1 for the first embodiment with an amount of lubricant defined and reduced by lubricant being drawn off by suction.

A first embodiment of a reciprocating piston compressor for refrigerant according to the invention, illustrated in FIGS. 1 and 2, comprises a crankcase 10, in which a crank drive 12 is provided and which forms a collecting chamber 14 for lubricant 16, for example, oil which collects in the collecting chamber 14 during the lubrication of the reciprocating piston compressor and forms a bath 18 of lubricant, the surface level 20 of which varies according to the amount of lubricant 16 in the lubricant bath 18.

Furthermore, a cylinder housing 22, in which a reciprocating piston 24 can be moved back and forth, driven by the crank drive 12, is connected to the crankcase 10, wherein a cylinder chamber 26 is available for the compression of refrigerant.

The cylinder chamber 26 is closed on its side located opposite the crank drive 12 by a valve plate which is designated as a whole as 30 and in which at least one inlet valve 32 as well as at least one outlet valve 34 are provided per cylinder chamber 26.

A cylinder head 40, which engages over the valve plate 30 and in which a suction gas duct 42 which reaches as far as the inlet valve 32 and a compression gas duct 44 which leads away from the outlet valve 34 are provided, is also provided on a side of the valve plate 30 located opposite the cylinder chamber 26, wherein the suction gas duct 42 is designed as a conduit 48 which leads from a suction gas connection 46 to the inlet valve 32 and predominantly extends, for example, immediately above the valve plate 30.

Refrigerant to be compressed will be supplied to the inlet valve 32 in the valve plate 30 via the suction gas duct 42 in the cylinder head 40 depending on the operating cycle of the reciprocating piston 24, namely when the reciprocating piston 24 carries out a suction movement, or the refrigerant in the suction gas duct 42 remains essentially without flow, namely when the reciprocating piston 24 carries out a compression movement and compresses the refrigerant in the cylinder 26 and, finally, expels it into the compressed gas duct 44 via the outlet valve 34.

During operation of such a reciprocating piston compressor in a complex system with a refrigerant circuit, particularly with several compressors which are arranged one after the other, there is the risk of an excessively large amount of lubricant 16 collecting in the collecting chamber 14 thereof and, therefore, of possibly too little lubricant being available in other components of the system or of an unnecessarily large amount of lubricant being needed for operation in the system in order to ensure a flow-free operation in the case of such an accumulation of lubricant in a reciprocating piston compressor.

In order to avoid this problem, the suction gas duct 42 in the first embodiment is provided with a nozzle 50, in which acceleration of a stream 52 of suction gas takes place prior to it reaching the inlet valve 32.

An area 54 of reduced pressure, in which a pressure P1 can be achieved which is below a pressure P2 in the crankcase 10, occurs in the nozzle 50 on account of the acceleration of the stream 52 of suction gas.

An outlet opening 56 of a lubricant suction conduit which is designated as a whole as 60 is provided in the area 54, the inlet opening 62 of the lubricant suction conduit being arranged in the collecting chamber 14 of the crankcase 10, namely at a distance A from a base 64 of the collecting chamber 14 so that lubricant 16 can be drawn in through the inlet opening 62 by suction only for such a time until, as illustrated in FIG. 2, the surface level 20 of the lubricant bath 18 is at the height of the inlet opening 62.

In this respect, the lubricant suction conduit 60 is preferably designed as a pipe 66 which reaches from the area 54 in the nozzle 50 as far as the inlet opening 62 and, as a result of the position of the inlet opening 62, defines the position of the surface level 20 of the lubricant bath 18, at which it is still just possible to draw in lubricant by suction via the lubricant suction conduit 60 whereas when the surface level 20 sinks further it is no longer possible to draw in lubricant by suction.

As a result of the fact that the pressure P1 is lower in the area 54 than the pressure P2 in the crankcase 10, in particular in the collecting chamber 14, when a stream 52 of suction gas is flowing through the nozzle 50, it is possible to draw lubricant out of the crankcase 10 by suction via the lubricant suction conduit 60 for as long as the surface level 20 is higher than the inlet opening 62 and until such time as the surface level 20 is at the level of the inlet opening 62 of the lubricant suction conduit 60.

The lubricant drawn into the nozzle 50 by suction will be supplied to the cylinder chamber 26 by the stream 52 of suction gas via the inlet valve 32 and from there be expelled with the compressed refrigerant via the outlet valve 34 and, therefore, discharged via the compressed gas duct 44, for example conveyed with the compressed gas to the next refrigerant compressor.

Figure 3:
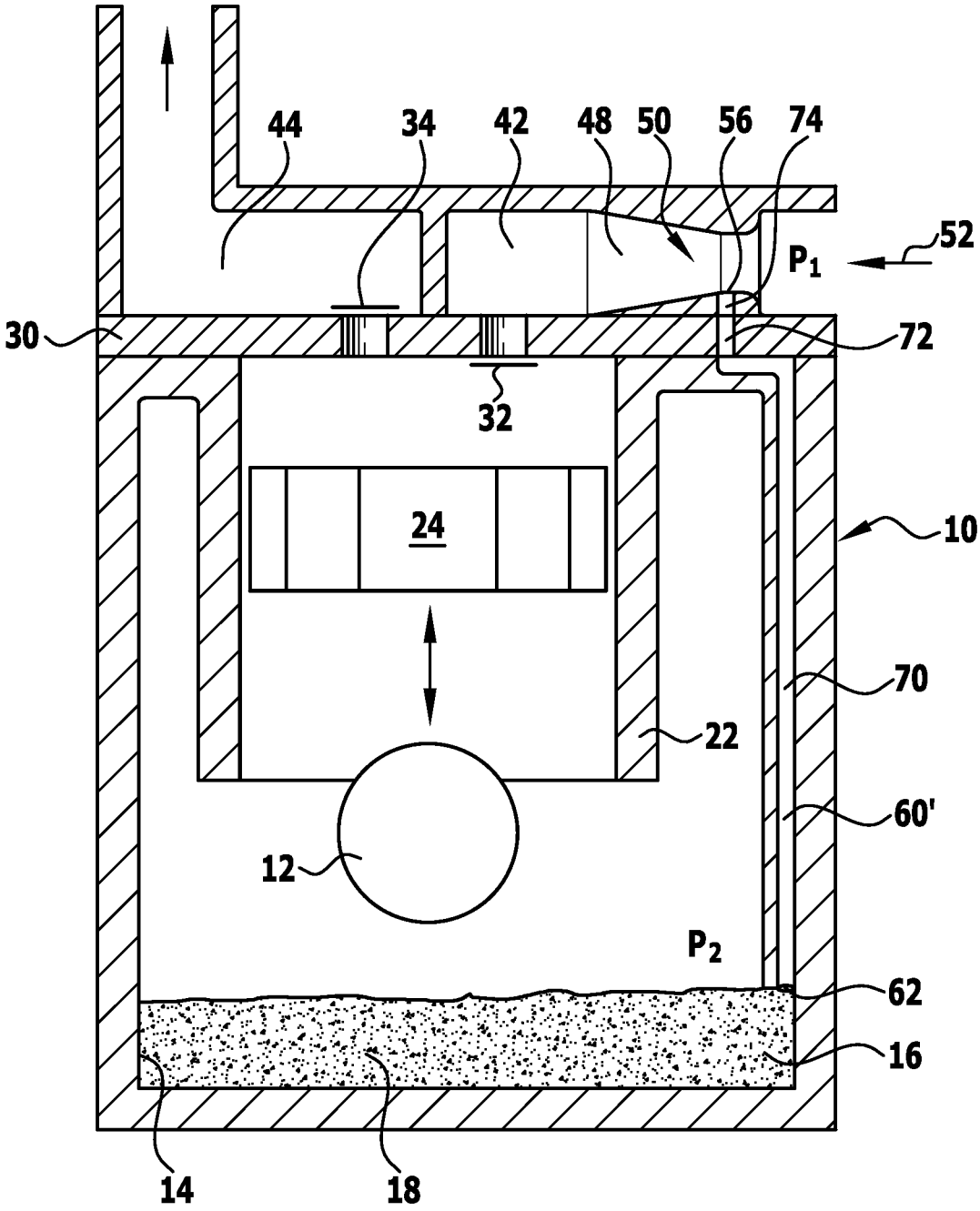
FIG. 3 shows a section similar to FIG. 1 through a second embodiment.

In a second embodiment of a reciprocating piston compressor according to the invention, illustrated in FIG. 3, all those parts which are identical to those of the first embodiment are provided with the same reference numerals and so, with respect to their description, reference can be made in full to the explanations concerning the first embodiment.

In contrast to the first embodiment, the lubricant suction conduit 60' is not formed by a pipe 66 but is rather integrally formed into the crankcase 10, for example a wall area 70 thereof, so that the lubricant suction conduit 60' extends in the wall area 70 as far as the inlet opening 62, passes, in addition, through a passage 72 in the valve plate 30 and, finally, passes through a passage 74 in the nozzle 50 which reaches as far as the outlet opening 56 in the nozzle 50.

Figure 4:
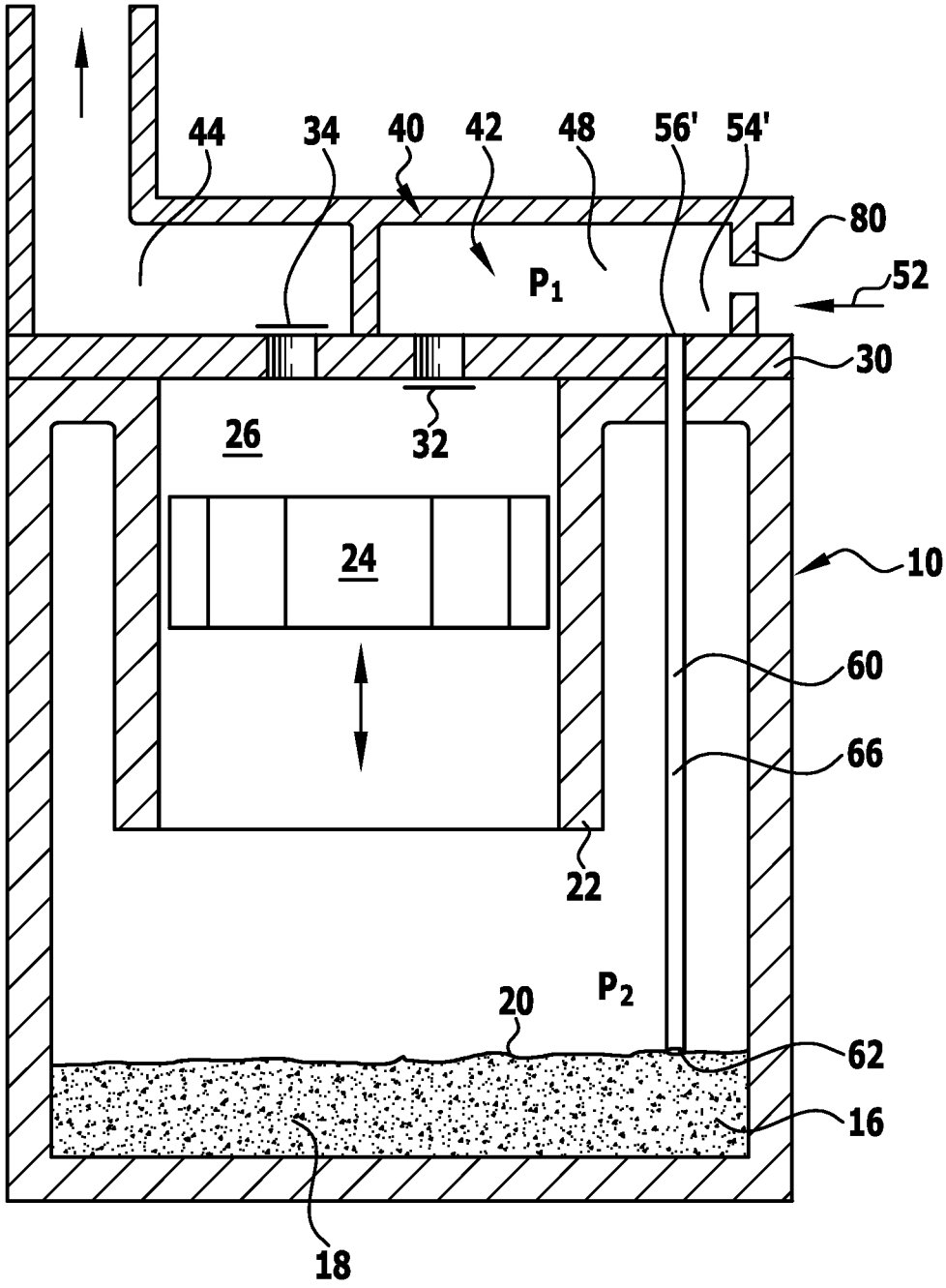
FIG. 4 shows a section similar to FIG. 1 through a third embodiment.

In a third embodiment of a reciprocating piston compressor according to the invention, illustrated in FIG. 4, those parts which are identical to those of the first or second embodiments are likewise provided with the same reference numerals and so reference can be made in full to the description thereof.

In the third embodiment, the lubricant suction conduit 60 extends in the pipe 66, namely from the inlet opening 62 as far as an outlet opening 56' which, in this embodiment, is located in the area of a side of the valve plate 30 facing the suction gas duct 42 and so the outlet opening 56' borders directly on the conduit 48 provided in the cylinder head 40.

In order to generate a static pressure $P_1$ in the conduit 48 in the area of the outlet opening 56' which is lower than the static pressure $P_2$ in the crankcase 10, in particular in the collecting chamber 14, a screen 80 is provided as a throttling device upstream of the outlet opening 56' with respect to the stream 52 of suction gas and this screen leads to a drop in pressure downstream of the screen 80 when the reciprocating piston 24 carries out a suction intake movement with an increase in the size of the cylinder chamber 26 and so the static pressure $P_1$ in the area 54' between the screen 80 and the inlet valve 32 drops for a short time during the suction intake movement 24 and, therefore, a static pressure $P_1$ is set, at least for a short time, which is lower than the pressure $P_2$ in the crankcase 10, in particular in the collecting chamber 14, and so during this time, during which the static pressure $P_1$ is lower than the static pressure $P_2$, lubricant is drawn out of the collecting chamber 14 by suction via the lubricant suction conduit 60 when the surface level 20 is above the inlet opening 62.

In all the cases, in which the static pressure $P_1$ in the conduit 48 is at an equally high pressure to the static pressure $P_2$ in the crankcase 10 or higher, no lubricant 16 will be drawn out of the collecting chamber 14 by suction but this does not represent any disadvantage since a temporary intake of lubricant by suction through the lubricant suction conduit 60 into the area 54, which is repeated in each operating cycle, is already sufficient to maintain the surface level 20 of the lubricant bath 18 at an average with respect to time in the area of the inlet opening 62.

Figure 5:
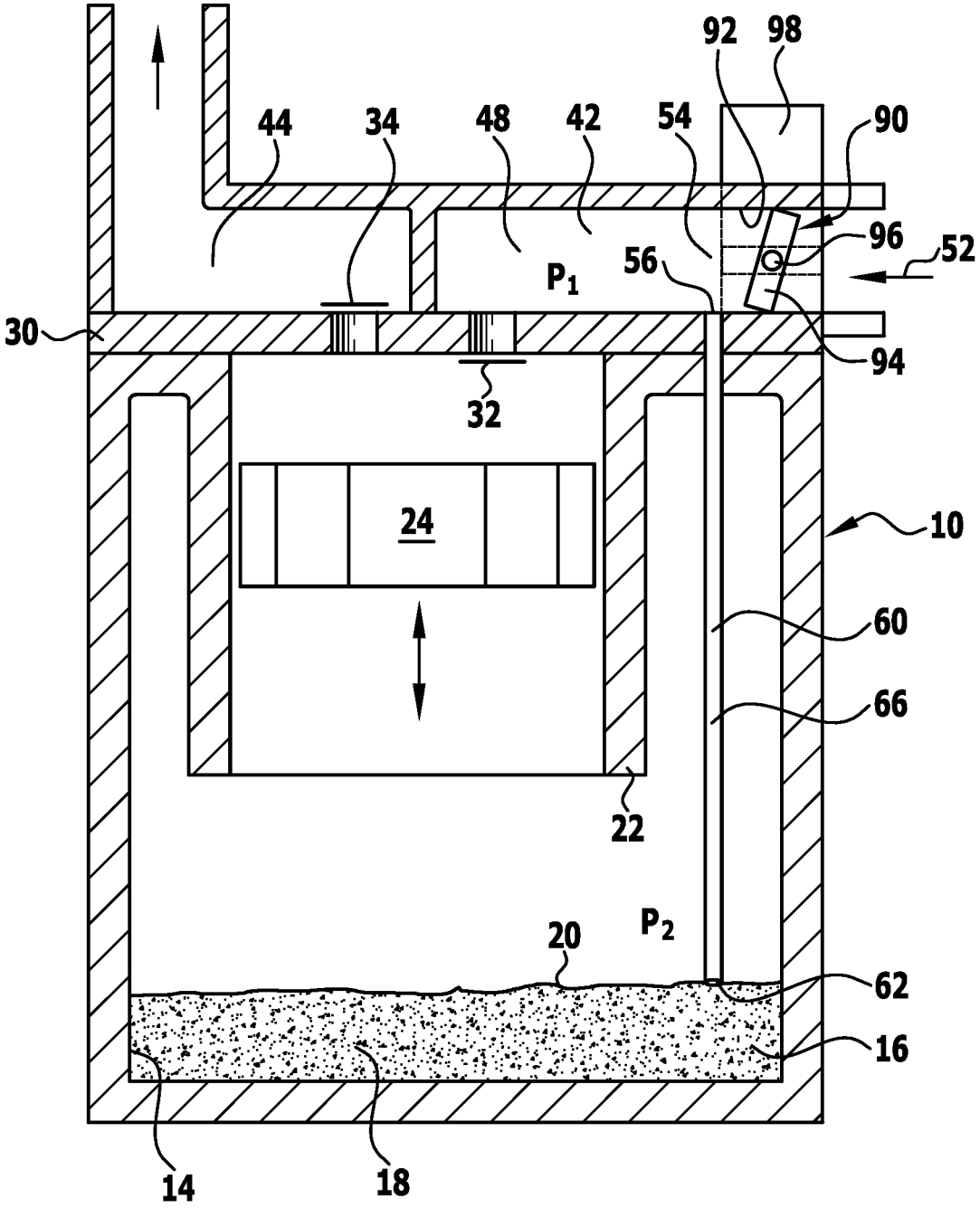
FIG. 5 shows a section similar to FIG. 1 through a fourth embodiment.

In a fourth embodiment of a reciprocating piston compressor according to the invention, illustrated in FIG. 5, those parts which are identical to one of the preceding embodiments are likewise provided with the same reference numerals and so, with respect to the description thereof, reference can be made in full to the explanations concerning the preceding embodiments.

In this embodiment, as well, the outlet opening 56 is located at the valve plate 30, namely in the area 54' which is located between an adjustable throttling device 90 and the inlet valve 32.

The throttling device 90 comprises a passage 92 which is adjustable with respect to its throttling effect for the stream 52 of suction gas with an adjustable throttle valve 94, for example a throttle valve 94 pivotable about an axis 96, wherein an actuating drive 98 is, for example, provided.

As a result, the same effect can, in principle, be achieved as with the screen 80 but with the difference that the throttling device 90 is adjustable with respect to its throttling effect on the stream 52 of suction gas as a result of rotation of the throttle valve 94 so that it is possible to adjust the pressure $P_1$, namely in accordance with the stream 52 of suction gas, so that the static pressure $P_1$ drops, for example, during certain partial phases of the suction intake movement of the reciprocating piston 24, to such an extent that this pressure is lower than the static pressure $P_2$ in the crankcase 10, in particular in the collecting chamber 14, and, therefore, it is possible to draw lubricant out of the collecting chamber 14 by suction and supply it to the stream 52 of suction gas for transporting further.

This solution has the advantage that, as a result of the throttle valve 94 being adjustable by means of the actuating drive 98 in accordance with the operating conditions of the reciprocating piston compressor, the periods of time, at which the static pressure $P_1$ in the conduit 48 is lower than the static pressure $P_2$ in the crankcase 10, in particular in the collecting chamber 14 thereof, can be adjusted each time in adaptation to the stream 52 of suction gas.

The variation of the third embodiment described above therefore provides for the setting of the throttle valve 94 to remain constant over a plurality of operating cycles and, therefore, the setting can be brought about such that the static pressure P1 drops at least temporarily to such an extent that lubricant 16 will be drawn in by suction via the lubricant suction conduit 60.

Alternatively, it is, however, also conceivable to carry out the adjustment of the throttle valve 94 dynamically, i.e., for example, to adjust the throttle valve 94 to a specific value for the throttling of the stream 52 of suction gas during the course of each operating cycle in order to reduce the static pressure P1 in the area 54' for a specific length of time.

It is, however, also conceivable not to use the throttle valve 94 during each operating cycle for the throttling of the stream 52 of suction gas but rather, for example, to control the flow of the stream 52 of suction gas with the throttle valve 94 only during one or a few operating cycles and then to control the throttle valve 94 for a plurality of operating cycles such that throttling no longer takes place so that during periods of time corresponding to a great number of operating cycles no throttling whatsoever of the stream 52 of suction gas takes place by way of the throttle valve 94 in order not to impair the compressor capacity and throttling of the stream 52 of suction gas takes place with the throttle valve 94 only when a short-term impairment of the compressor capacity is accepted in order to draw lubricant out of the collecting chamber 14 by suction via the lubricant suction conduit 60 while, subsequently, the throttle valve 94 will be opened again for an appreciably long period of time in order to, on the other hand, have the full compressor capacity available.

The invention claimed is:

1. Reciprocating piston compressor for a refrigerant circuit, comprising a crankcase, a collecting chamber for lubricant being arranged in said crankcase, a cylinder housing, at least one reciprocating piston being movable in an oscillating manner in said cylinder housing, a valve plate closing the cylinder housing, at least one inlet valve and one outlet valve being arranged in said valve plate, and a cylinder head, a suction gas duct running to the inlet valve and a compressed gas duct leading away from the outlet valve, said suction gas duct being provided in said cylinder head, a lubricant suction conduit, said conduit having an inlet opening associated with the collecting chamber, the inlet opening of the lubricant suction conduit being arranged in said collecting chamber at a distance from a bottom of said collecting chamber such that it predetermines a lowest surface level of the lubricant bath achievable as a result of lubricant being drawn off by suction via the lubricant suction conduit, said lowest level representing a sufficient amount of lubricant for said reciprocating piston compressor, said lubricant suction conduit having an outlet opening associated with the suction gas duct, the outlet opening being located in an area of the suction gas duct where a static pressure prevails at least temporarily, said pressure being lower than a static pressure in the collecting chamber for lubricant; and wherein the outlet opening of the lubricant suction conduit is connected to the suction gas duct and not the cylinder housing and conveys lubricant he suction conduit during an operational state.

2. Reciprocating piston compressor as defined in claim 1, wherein the lubricant suction conduit extends at least in sections through a pipe projecting into the crankcase.

3. Reciprocating piston compressor as defined in claim 2, wherein the pipe has the inlet opening.

4. Reciprocating piston compressor as defined in claim 1, wherein the lubricant suction conduit extends in the crankcase at least in sections.

5. Reciprocating piston compressor as defined in claim 1, wherein the area having the outlet opening of the lubricant suction conduit is located in a narrow region of a nozzle.

6. Reciprocating piston compressor as defined in claim 1, wherein the area of the suction gas duct having the outlet opening of the lubricant suction conduit is located behind a throttling device in the suction gas duct in flow direction of the stream of suction gas.

7. Reciprocating piston compressor as defined in claim 6, wherein the throttling device is designed as a screen.

8. Reciprocating piston compressor as defined in claim 6, wherein the throttling device is an adjustable throttling device.

9. Reciprocating piston compressor as defined in claim 8, wherein the adjustable throttling device alternates between time intervals essentially free of throttling and time intervals with active throttling.

10. The reciprocating piston compressor of claim 1, wherein the outlet opening of the lubricant suction conduit is connected to the suction gas duct at a location upstream of the inlet valve and a location outside of the cylinder housing.

11. The reciprocating piston compressor of claim 1, further comprising a restriction orifice provided in the suction gas duct creating a venturi effect, the outlet opening of the lubricant suction conduit being located in close proximity to the restriction orifice to be subject to the venturi effect for suctioning lubricant through the lubricant suction conduit.

12. The reciprocating piston compressor of claim 1, wherein the reciprocating piston compressor has an operational state wherein the piston is reciprocating in the cylinder housing, and the lubricant level is maintained at no greater than the inlet opening of the lubricant suction conduit.

13. The reciprocating piston compressor of claim 1, wherein lubricant drawn out of the collecting chamber through the lubricant conduit by suction is applied to the suction gas which then conveys this lubricant through the reciprocating piston compressor and further into the refrigerant circuit via the compressed gas duct.

14. The reciprocating piston compressor of claim 13, wherein at least some lubricant suctioned through the lubricant conduit is conveyed to another compressor in a refrigerant circuit.

15. The reciprocating piston compressor of claim 1, wherein the reciprocating piston compressor has a first operational state in which lubricant is above the lubricant suction conduit and a second operation state in which lubricant is below the lubricant suction conduit and in which state no lubricant is drawn wherein an amount of lubricant in the collection chamber is sufficient for lubricating the reciprocating piston compressor during operation of the compressor.

16. The reciprocating piston compressor of claim 1, wherein the outlet opening of the lubricant suction conduit is continuously open and not closed at any position of the reciprocating piston.

17. The reciprocating piston compressor of claim 1, wherein the lubricant suction conduit extends inside of the crankcase and not external to the crankcase.

18. Reciprocating piston compressor for a refrigerant circuit, comprising a crankcase, a collecting chamber for lubricant being arranged in said crankcase, a cylinder housing, at least one reciprocating piston being movable in an oscillating manner in said cylinder housing, a valve plate closing the cylinder housing, at least one inlet valve and one outlet valve being arranged in said valve plate, and a cylinder head, a suction gas duct running to the inlet valve and a compressed gas duct leading away from the outlet valve, said suction gas duct being provided in said cylinder head, a lubricant suction conduit, said conduit having an inlet opening associated with the collecting chamber, the inlet opening of the lubricant suction conduit being arranged in said collecting chamber at a distance from a bottom of said collecting chamber such that it predetermines a lowest surface level of the lubricant bath achievable as a result of lubricant being drawn off by suction via the lubricant suction conduit, said lowest level representing a sufficient amount of lubricant for said reciprocating piston compressor, said lubricant suction conduit having an outlet opening associated with the suction gas duct, the outlet opening being located in an area of the suction gas duct where a static pressure prevails at least temporarily, said pressure being lower than a static pressure in the collecting chamber for lubricant; and wherein the outlet opening of the lubricant suction conduit is connected to the suction gas duct at a location upstream of the inlet valve and a location outside of the cylinder housing.

19. Reciprocating piston compressor for a refrigerant circuit, comprising a crankcase, a collecting chamber for lubricant being arranged in said crankcase, a cylinder housing, at least one reciprocating piston being movable in an oscillating manner in said cylinder housing, a valve plate closing the cylinder housing, at least one inlet valve and one outlet valve being arranged in said valve plate, and a cylinder head, a suction gas duct running to the inlet valve and a compressed gas duct leading away from the outlet valve, said suction gas duct being provided in said cylinder head, a lubricant suction conduit, said conduit having an inlet opening associated with the collecting chamber, the inlet opening of the lubricant suction conduit being arranged in said collecting chamber at a distance from a bottom of said collecting chamber such that it predetermines a lowest surface level of the lubricant bath achievable as a result of lubricant being drawn off by suction via the lubricant suction conduit, said lowest level representing a sufficient amount of lubricant for said reciprocating piston compressor, said lubricant suction conduit having an outlet opening associated with the suction gas duct, the outlet opening being located in an area of the suction gas duct where a static pressure prevails at least temporarily, said pressure being lower than a static pressure in the collecting chamber for lubricant; and wherein the outlet opening of the lubricant suction conduit is continuously open and not closed at any position of the reciprocating piston.

* * * * *

UNITED STATES PATENT AND TRADEMARK OFFICE

CERTIFICATE OF CORRECTION

PATENT NO. : 8,690,545 B2
APPLICATION NO. : 12/831508
DATED : April 8, 2014
INVENTOR(S) : Eduardo Martin It is certified that error appears in the above-identified patent and that said Letters Patent is hereby corrected as shown below:

In the Claims

Claim 1, Column 7, Line 22
The words "lubricant he suction conduit..." should correctly read "lubricant into the suction gas conduit...".

Signed and Sealed this
Fifth Day of August, 2014

Michelle K. Lee

Michelle K. Lee
*Deputy Director of the United States Patent and Trademark Office*